US011066144B1

(12) United States Patent
Sanders

(10) Patent No.: US 11,066,144 B1
(45) Date of Patent: Jul. 20, 2021

(54) TILLER CONTROL FOR BOATS

(71) Applicant: Henry Sanders, Hilton Head Island, SC (US)

(72) Inventor: Henry Sanders, Hilton Head Island, SC (US)

( * ) Notice: Subject to any disclaimer, the term of this patent is extended or adjusted under 35 U.S.C. 154(b) by 0 days.

(21) Appl. No.: 16/839,974

(22) Filed: Apr. 3, 2020

(51) Int. Cl.

| | |
|---|---|
| ***B63H 25/00*** | (2006.01) |
| ***B63H 25/04*** | (2006.01) |
| ***B63H 25/10*** | (2006.01) |
| ***B63H 25/34*** | (2006.01) |
| ***B63H 25/38*** | (2006.01) |
| ***B63H 25/52*** | (2006.01) |

(52) U.S. Cl.
CPC ..... *B63H 25/38* (2013.01); *B63H 25/00* (2013.01); *B63H 25/04* (2013.01); *B63H 25/10* (2013.01); *B63H 25/34* (2013.01); *B63H 25/52* (2013.01)

(58) Field of Classification Search
CPC ..... B63H 25/00; B63H 25/04; B63H 25/10; B63H 25/34; B63H 25/38; B63H 25/52
USPC ..... 114/144 R, 162, 170, 172; 440/62
See application file for complete search history.

(56) References Cited

U.S. PATENT DOCUMENTS

| | | | | |
|---|---|---|---|---|
| 2,895,445 | A * | 7/1959 | Foraker | B63H 21/265 440/62 |
| 2,949,093 | A * | 8/1960 | Smith | B63H 21/265 440/62 |
| 3,417,723 | A * | 12/1968 | Akermanis | B63H 21/265 114/144 R |
| 4,003,328 | A | 1/1977 | Feldman | |
| 4,080,918 | A | 3/1978 | Bonhard | |
| 4,241,684 | A | 12/1980 | Davis | |
| 4,366,767 | A * | 1/1983 | Knoos | B63H 25/04 114/144 R |
| 4,476,800 | A | 10/1984 | Gage | |
| 4,480,572 | A | 11/1984 | Lauterbach | |
| 4,907,521 | A | 3/1990 | Kresse | |
| 5,052,321 | A | 10/1991 | Toniatti | |
| 8,069,803 | B1 | 12/2011 | Crawford | |

* cited by examiner

*Primary Examiner* — Lars A Olson
(74) *Attorney, Agent, or Firm* — B. Craig Killough; Hellman & Yates, PA

(57) ABSTRACT

A tiller control for boats comprising a brake that holds a control line in a static position. In turn, the control line holds the tiller and rudder of the boat in a static position. The amount of pressure applied to the control line by the brake is adjustable. Pressure applied to the control line by the brake may be adjusted so that the tiller and rudder are held in a generally static position, but the tiller control can be manually overridden.

10 Claims, 5 Drawing Sheets

TILLER CONTROL FOR BOATS

BACKGROUND OF THE INVENTION

When boating, it is sometimes beneficial for the helmsman to be able to fix a tiller and rudder in a static position. Setting the tiller in the static or fixed position allows the boat to continue its course without the helmsman having to manually steer the vessel. The helmsman can attend to other matters, such as trimming sails or other tasks, without being in physical contact with the tiller.

Most auto pilot devices that are available for boats are complex and expensive. On the other extreme, inexpensive devices that hold the tiller in position do not typically allow for minor adjustments or easy override of the position of the tiller.

SUMMARY OF THE INVENTION

The present invention is a tiller control for boats comprising a brake that holds a control line in a static position. In turn, the control line holds the tiller and rudder of the boat in a static position. The amount of pressure applied to the control line by the brake is adjustable. Pressure applied to the control line by the brake may be adjusted so that the tiller and rudder are held in a generally static position, but the tiller control can be manually overridden.

BRIEF DRAWING DESCRIPTION

DESCRIPTION OF PREFERRED EMBODIMENTS

Figure 3:
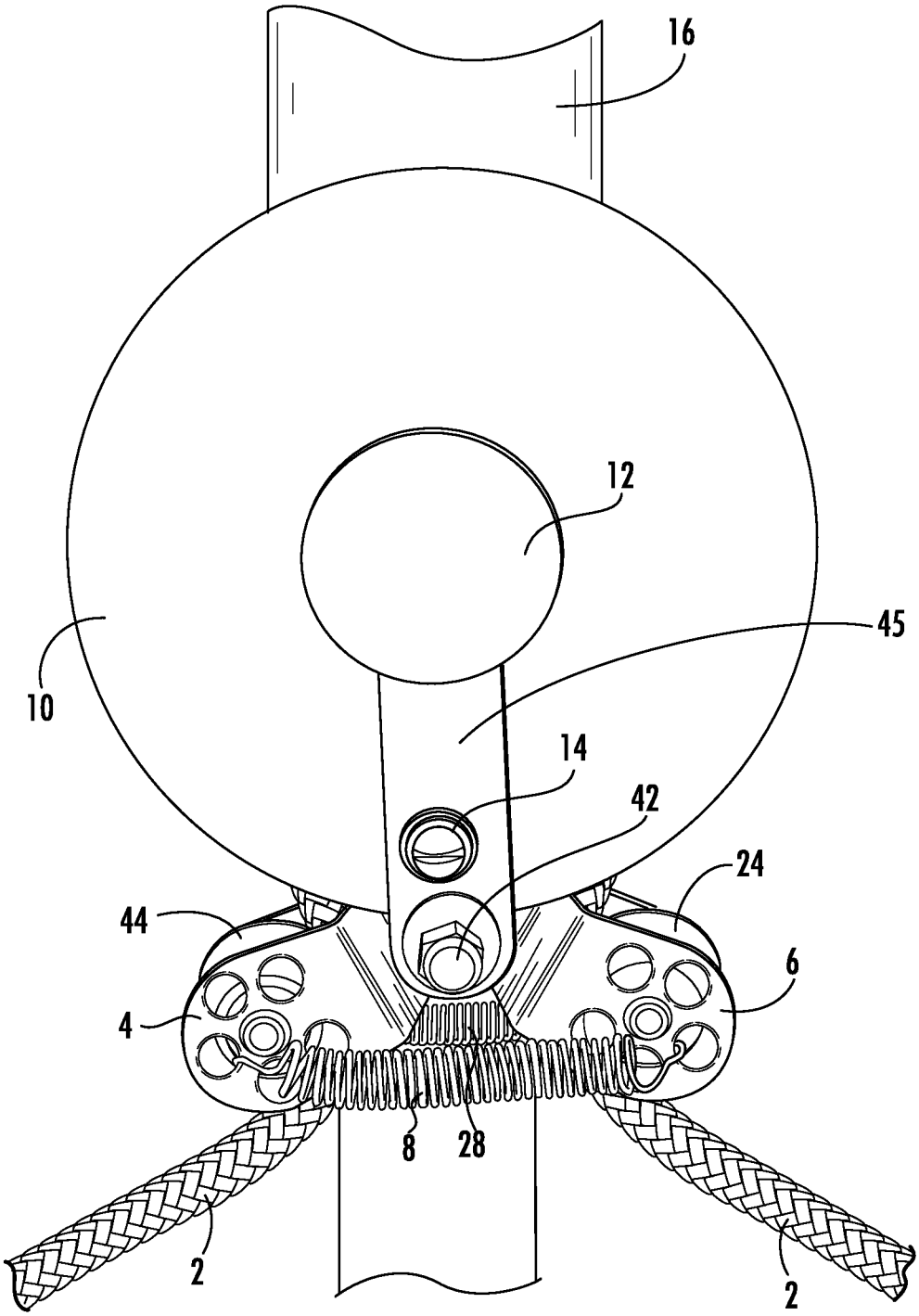
FIG. 3 is a top plan view of the tiller control device enlarged from the top plan view of FIG. 2.

FIG. 3 shows elements of a preferred embodiment of the invention. Beginning with the control line 2 shown on the lower left side of FIG. 3, the control line enters a first control line tensioning block 4. Opposite the first control line tensioning block is a second control line tensioning block 6. The first control line tensioning block and the second control line tensioning blocks are in a spring biased relationship provided by, for example, tensioning springs 8, 28. The control line passes through the first tensioning block and into the brake construct. The brake construct as shown in FIG. 3 includes a control line guide brake pressure plate 10, a resistance control knob 12, and preferably a control line guide brake pressure plate alignment screw 14. The construct is mounted to a tiller 16.

Figure 4:
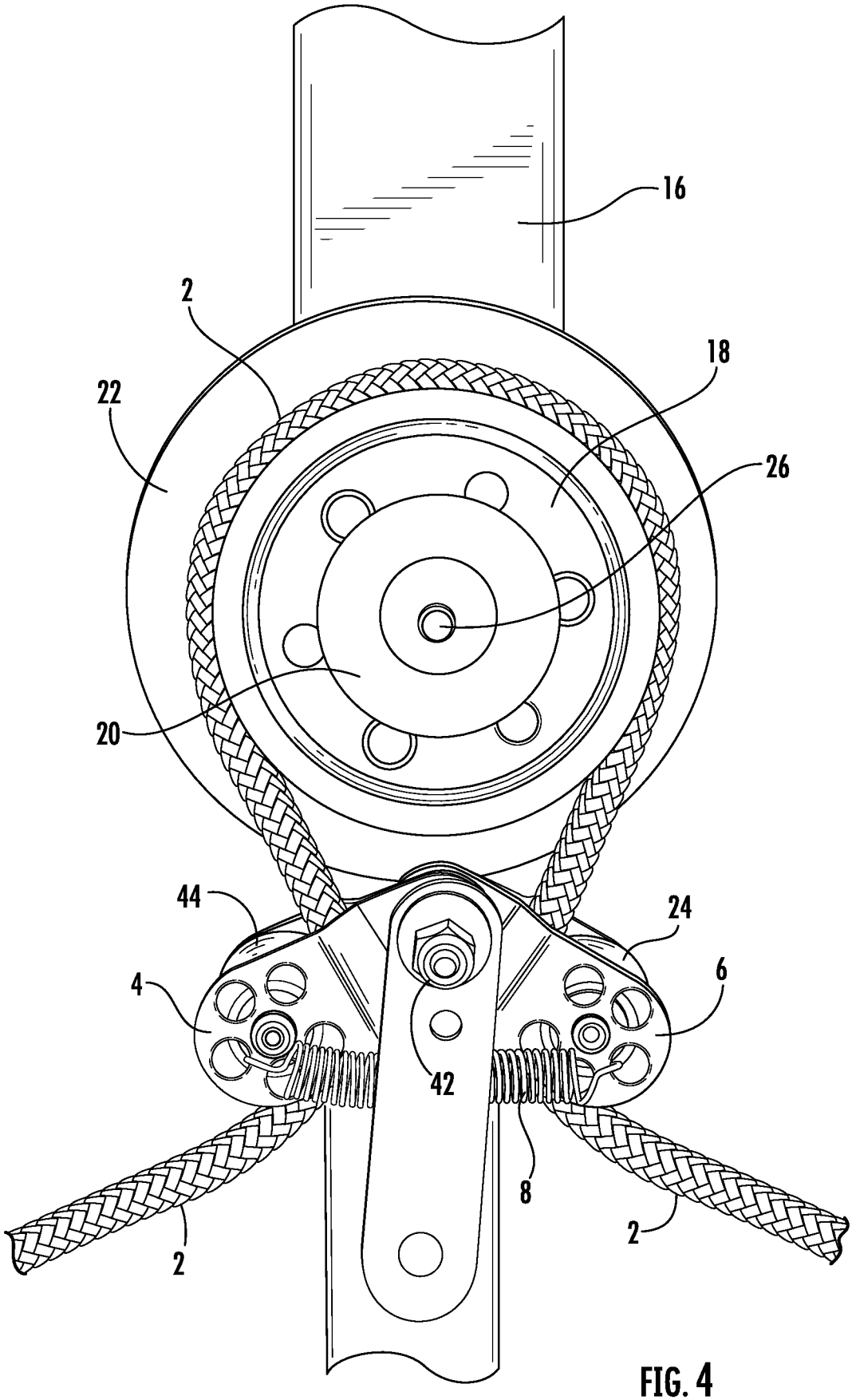
FIG. 4 is a top plan view of the tiller control for boats with the control line pressure plate removed to show the internal elements of the brake according to a preferred embodiment of the invention.

The internal elements of the brake construct and its relationship with the control line 2 are shown in FIG. 4, the control line guide brake pressure plate 10 and resistance control knob 12 are removed to demonstrate the internal elements of the brake construct. In this embodiment, the brake construct includes a control line sheave 18 and a braking ring 20. The control line passes through the sheave

44 of the first control line tensioning block 4, the control line sheave 18, and the sheave 24 of the second control line tensioning block 6. A control line guide 22 is positioned under the control line braking sheave 18.

Figure 5:
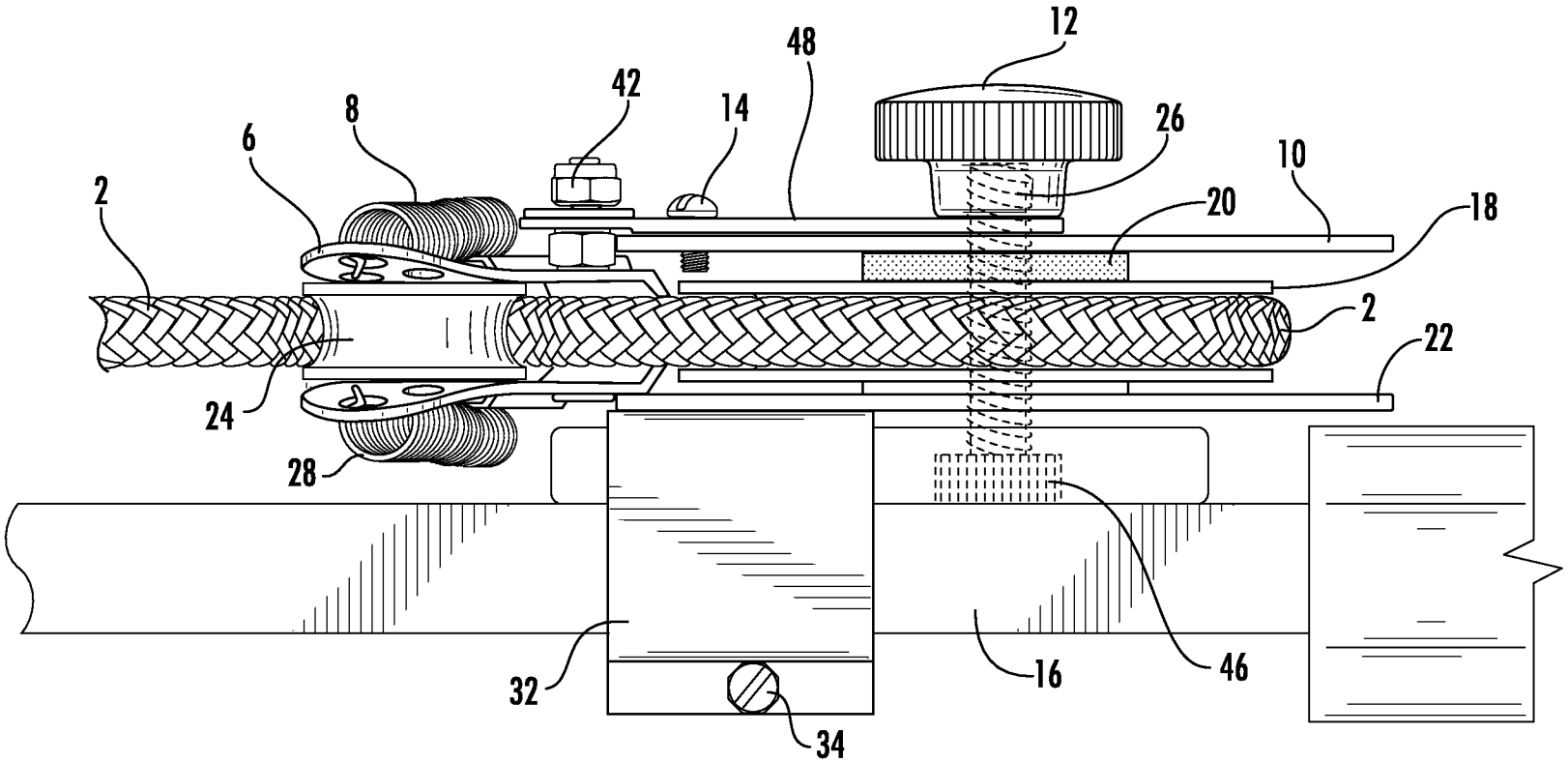
FIG. 5 is a side elevation of the tiller control device.

FIG. 5 is a side elevation showing elements of the tiller control for boats. A second tensioning spring 28 is shown as used in this embodiment. The resistance control knob 12 communicates with a threaded member 26 that allows threads formed in the resistance control knob to rotate and apply pressure on the control line guide brake pressure plate 10, which in turn applies pressure to the braking ring 20. The braking ring has elastomeric properties, and applies resistance pressure to the control line braking sheave 18 when the resistance control knob is tightened against the control line guide brake guide brake pressure plate, thereby inhibiting rotation. When the resistance control knob is rotated in an opposite direction, pressure is relieved on the braking ring, allowing the control line braking sheave to rotate more freely. The threaded member may be anchored 46 below the brake construct.

Figure 1:
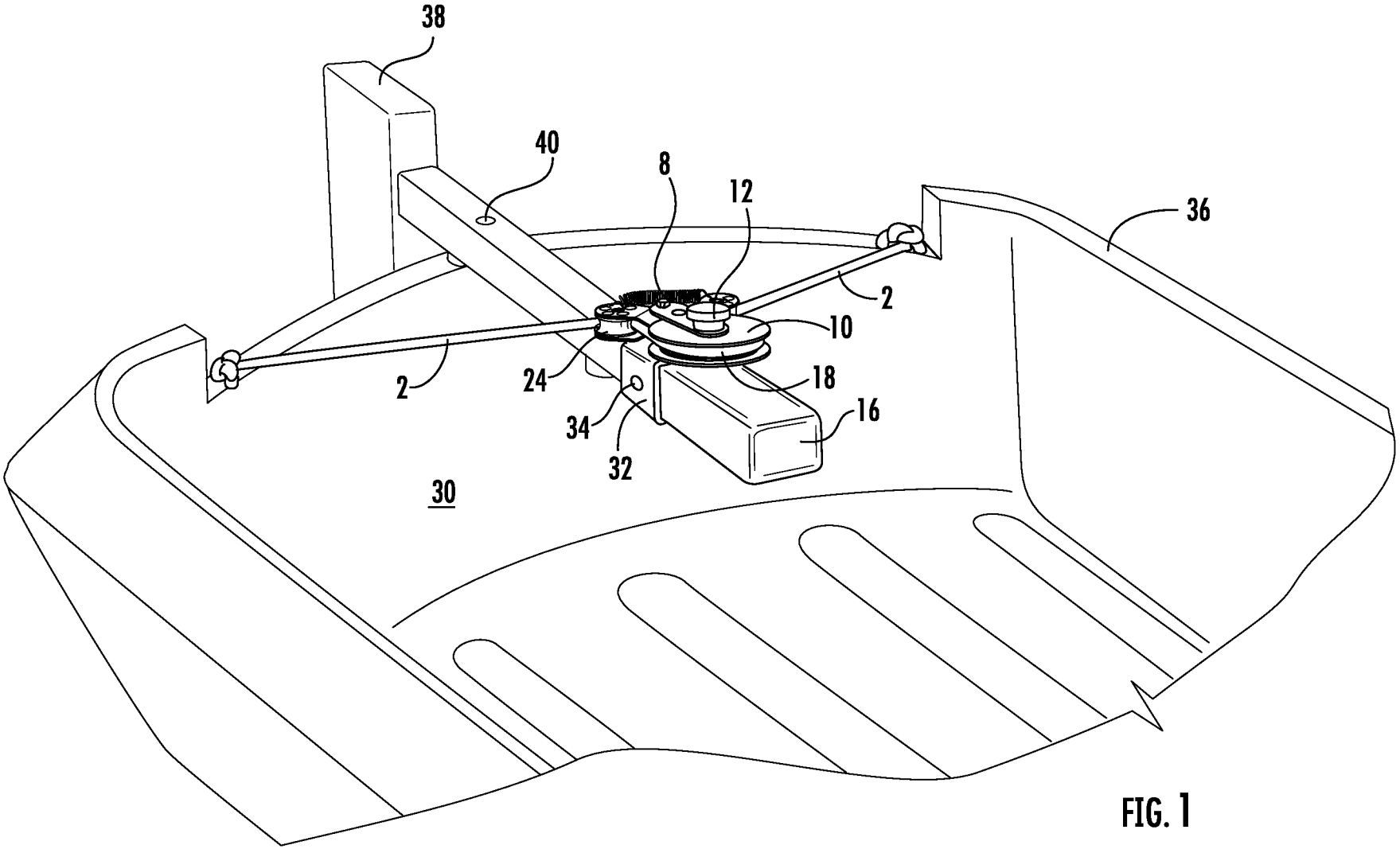
FIG. 1 is a perspective view of the tiller control device for boats mounted on a tiller of a boat according to an embodiment of the invention.
Figure 2:
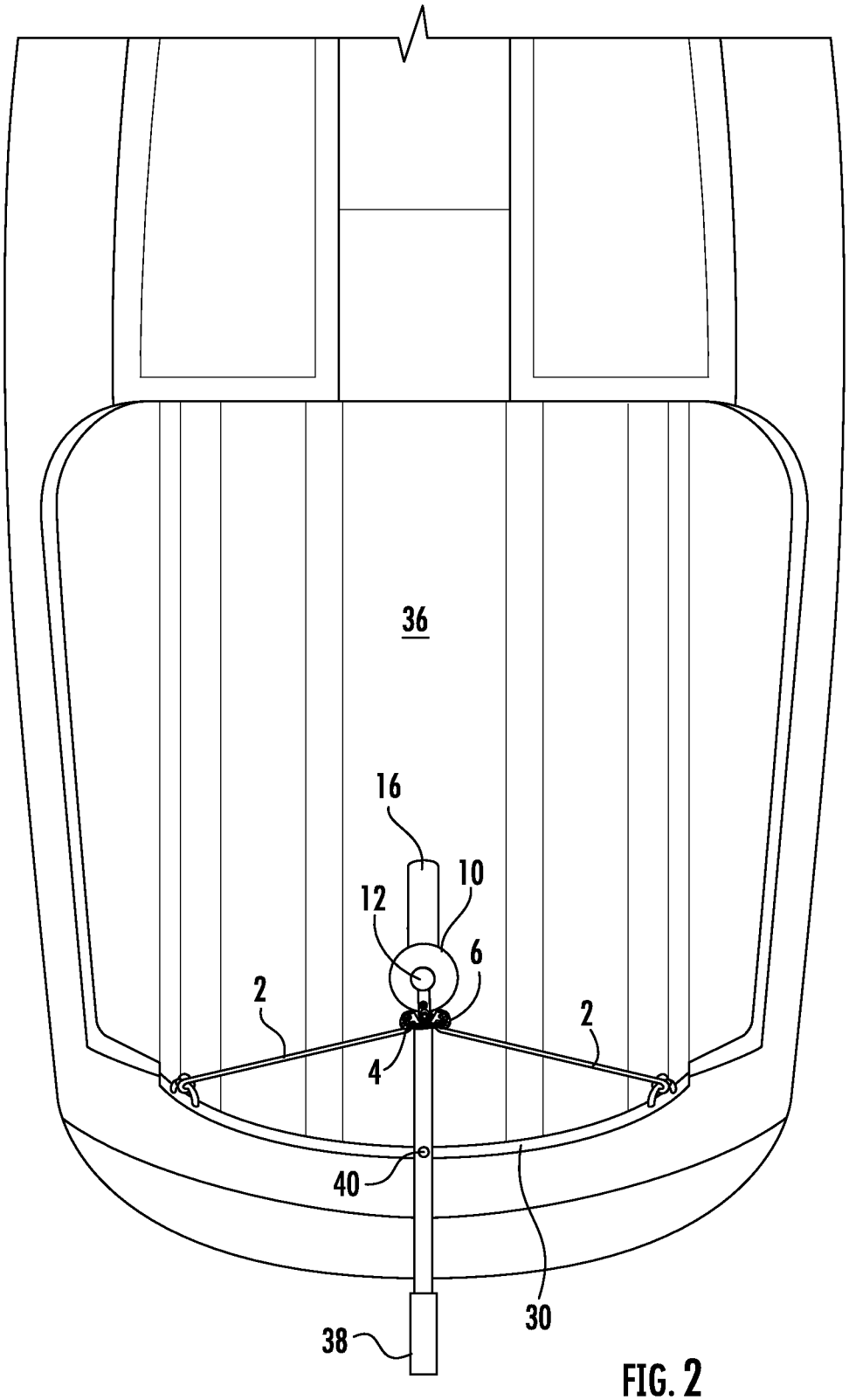
FIG. 2 is a top plan view of the tiller control device for boats shown in FIG. 1.

As shown in FIG. 1, the tiller control for boats is mounted to a tiller 16 of a boat 36, which may be a sailboat. The tiller control may be mounted to the tiller by various means, including a clamp 32 that surrounds the tiller and is tightly fixed in place such as by threaded connection 34. The control line 2 is mounted on opposite sides of the hull of the boat, such as on the stern 30 of the boat. Each end or side of the control line that is mounted to the boat should be mounted a sufficient distance from the tiller control and tiller so that movement of the tiller is not restricted by the control line when the brake construct is not engaged to inhibit or limit movement of the tiller. A control line may be fixed to the hull of the boat by various devices, including cleats to which the control line is tied.

In use, when the resistance control knob 12 is positioned so that material pressure is not applied to the control line braking sheave 18, the tiller may be used to steer the boat substantially as if the tiller control was not present. The resistance control knob is rotated so as to apply pressure on the control line guide brake pressure plate 10 and the braking ring 20. The brake construct resists movement of the tiller. Note that the length of the tiller from the rudder 38 to the pivot point 40 is typically shorter than the length of the opposite end of the tiller to the pivot point, so that the moment from the rudder to the pivot point is relatively less than the moment from the opposite end of the tiller to the pivot point.

The amount of resistance applied by the braking construct on the control line braking sheave 18 may be varied by the level of engagement of the resistance control knob 12. The helmsman may decide to apply substantial pressure on the braking ring 20 and the control line braking sheave, so that the rudder 38 position and direction of the boat 36 are fixed by the attitude of the tiller 16. Alternatively, less pressure may be applied by the brake construct on the control line 2 so that the tiller is held in place without manual input, but the tiller position can be overridden by the application of manual force that is sufficient to overcome the braking action of the braking construct on the control line. Therefore, the device may be set to prevent manual steering by applying sufficient pressure on the control line guide brake pressure plate and braking ring, or the device may be set to apply sufficient pressure on the control line braking sheave to hold the tiller and rudder in position without manual input, but the position of the tiller can be overridden with manual input.

The control line tensioning blocks 4,6 guide the control line 2 into and out of the brake construct generally, and the control line braking sheave 18 specifically. Spring biasing on the control line tensioning blocks holds the control line positioning blocks substantially in position, but allows some rotation of the control line positioning blocks. By limiting the movement of the control line positioning blocks, the control line positioning blocks are properly positioned to inhibit binding or tangling of the control line. A block mounting screw 42 may be used to the mount the control line tensioning blocks to the device, while permitting limited movement of the control line tensioning blocks.

In a preferred embodiment, the braking construct comprises a control line guide brake pressure plate alignment screw 14 and a brake pressure alignment strap 48. The brake pressure plate alignment screw aligns the control line guide brake pressure plate 10 with the brake pressure alignment strap to prevent the brake pressure plate from rotating with the braking ring 20 and the control line braking sheave 18, which would negatively impact braking force. The control line guide brake pressure plate alignment screw also keeps the control line guide brake pressure plate relatively level so that pressure is uniformly applied by the control line guide brake pressure plate to the braking ring.

The braking ring 20 is preferred to be formed of an elastomeric material. The braking ring may be formed of rubber, silicone, synthetic rubber or other elastomers.

What is claimed:

1. A tiller control for boats, comprising:

a brake, the brake comprising a control line braking sheave and a control line guide brake pressure plate;

a first control line tensioning block;

a second control line tensioning block;

a spring biasing device, the spring biasing device spring biasing the first control line tensioning block and the second control line tensioning block toward each other.

2. A tiller control for boats as described in claim 1, further comprising a resistance control that communicates with the control line guide brake pressure plate and regulates pressure on the control line guide brake pressure plate.

3. A tiller control for boats as described in claim 1, further comprising a braking ring that, in use, is positioned above the control line sheave and below the control line guide brake pressure plate.

4. A tiller control for boats as described in claim 1, further comprising an elastomeric braking ring that, in use, is positioned above the control line sheave and below the control line guide brake pressure plate.

5. A tiller control for boats as described in claim 1, further comprising a resistance control that communicates with the control line guide brake pressure plate and regulates pressure on the control line guide brake pressure plate, and further comprising a braking ring that, in use, is positioned above the control line braking sheave and below the control line guide brake pressure plate.

6. A tiller control for boats as described in claim 1, further comprising a resistance control that communicates with the control line guide brake pressure plate and regulates pressure on the control line guide brake pressure plate, and further comprising an elastomeric braking ring that, in use, is positioned above the control line braking sheave and below the control line guide brake pressure plate.

7. A tiller control for boats as described in claim 1, further comprising a threaded resistance control that extends through the control line braking sheave and communicates with the control line guide brake pressure plate and regulates pressure on the control line guide brake pressure plate, and further comprising a braking ring that, in use, is positioned above the control line braking sheave and below the control line guide brake pressure plate.

8. A tiller control for boats as described in claim 1, further comprising a control line, the control line extending through the first control line tensioning block, then around the control line braking sheave, and then through the second control line tensioning block.

9. A tiller control for boats as described in claim 1, further comprising a control line, the control line extending through the first control line tensioning block, then around the control line braking sheave, then through the second control line tensioning block, and further comprising a braking ring that, in use, is positioned above the control line braking sheave and below the control line guide brake pressure plate, wherein pressure on the control line guide brake pressure plate applies pressure to the braking ring restricting movement of the control line braking sheave and the control line.

10. A tiller control for boats as described in claim 1, further comprising a brake pressure plate alignment screw that contacts the control line guide brake pressure plate.

* * * * *